US006309474B1

(12) United States Patent
Yagasaki

(10) Patent No.: US 6,309,474 B1
(45) Date of Patent: Oct. 30, 2001

(54) PROCESS FOR PRODUCING MARAGING STEEL

(75) Inventor: Toru Yagasaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/518,719

(22) Filed: Mar. 3, 2000

(30) Foreign Application Priority Data

Mar. 4, 1999 (JP) ..... 11-056933
Jul. 15, 1999 (JP) ..... 11-201389

(51) Int. Cl.[7] ..... C23C 8/26
(52) U.S. Cl. ..... 148/230; 148/217
(58) Field of Search ..... 148/217, 230

(56) References Cited

U.S. PATENT DOCUMENTS 5,376,188 * 12/1994 Tahara et al. ..... 148/230

FOREIGN PATENT DOCUMENTS

10010383-A1 * 7/2000 (DE) .
58210152-A * 12/1983 (JP) .
59085711-A * 5/1984 (JP) .
61147814 * 7/1986 (JP) .
62-192528 8/1987 (JP) .
62-224665 10/1987 (JP) .
2-154834 6/1990 (JP) .
6-002073 1/1994 (JP) .
10-170502 6/1998 (JP) .
87214-A * 3/2000 (JP) .
444831 * 11/1974 (SU) .

* cited by examiner

*Primary Examiner*—Roy King
*Assistant Examiner*—Nicole Coy
(74) *Attorney, Agent, or Firm*—Arent Fox Kintner Plotkin & Kahn, PLLC

(57) ABSTRACT

In a method for producing maraging steel, a thin plate of maraging steel is subjected to an aging treatment, is then subjected to a fluoridation processing in which the thin plate is heated and maintained in a fluoric reacting gas including fluorine so as to form a fluoride layer on a surface of the thin plate, and is then subjected to nitriding in a nitriding reaction gas including ammonia gas so as to restrict the carbon concentration of the thin plate after the nitriding to 2 weight % or less.

9 Claims, 7 Drawing Sheets

PROCESS FOR PRODUCING MARAGING STEEL

BACKGROUND OF THE INVENTION

1. Technical Field

The present invention relates to a process for producing maraging steel suitable for steel belts for continuous variable transmissions, and specifically relates to a technology for providing large residual compressive stress in a material.

2. Background Arts

A steel belt such as that mentioned above is wound around a pulley, and is traveled at high speed; the steel belt is therefore required to have high wear resistance and high fatigue strength to withstand the traveling and bending. As materials for such steel belts, maraging steels have been used in recent years.

Maraging steel is a super-high-tension steel with a high nickel content and has high tensile strength and high toughness due to a supersaturated martensite solid solution in which alloy elements are dissolved through a solution treatment followed by aging. In the past, maraging steel has been used in dies, and recently it has attracted attention due to the high tensile strength thereof, and it has therefore been used in steel belts, such as that mentioned above.

However, maraging steel does not have sufficient fatigue strength. Therefore, when maraging steel is used for an application in which high bending stress is applied, nitriding is performed on a thin plate made from maraging steel, thereby providing residual compressive stress in the surface portion and increasing fatigue strength. As a nitriding method, Japanese Patent Application, Second Publication, No. 116585/95 discloses a gas nitriding method in which a thin plate is heated in an atmosphere of pure ammonia gas as an aging treatment. However, maraging steel is difficult to nitrify since an oxide film readily forms on the surface thereof. Therefore, there is a disadvantage in that the processing time must be lengthened in order to obtain the desired residual compressive stress.

Japanese Patent Application, Second Publication, No. 82452/93 discloses a method in which material is bent after a solution treatment to obtain residual compressive stress and is subjected to ammonia gas nitriding as aging treatment. The publication notes that the method can promote nitriding by providing residual compressive stress before the nitriding processing, and can increase surface hardness and residual compressive stress. However, it has been demonstrated that the residual stress provided before the nitriding processing is relaxed by the nitriding processing, and the required residual compressive stress cannot be obtained by this method. Moreover, control of the nitriding processing is difficult since it occurs rapidly, and therefore the effects of the nitriding processing varies greatly. There was also a problem in that the quality thereof varied from batch to batch.

Japanese Patent Application, First Publication, No. 154834/90 proposes a method in which material is subjected to an ammonia gas nitriding processing after aging and is then shot-peened. The publication notes that the duration for nitriding can be controlled, and therefore the desired residual compressive stress can be reliably obtained.

However, the method in Japanese Patent Application, First Publication, No. 154834/90 poses a problem in that the duration for nitriding processing is long and the producing cost is high since the method requires the additional process of shot-peening.

It is known that inclusions contained in steel belts greatly affect fatigue strength in high cycle fatigue tests, and that larger inclusions more can more readily initiate fatigue failure, thereby shortening the service life of the steel belts. FIG. 5 is a diagram showing the relationship between the frequency of the repeated bending load and the tension load applied to the steel belt when a fatigue failure occurred in a steel belt which was wound around two pulleys and is traveled. As shown in FIG. 5, in the low cycle side in which the frequencies of the repeated bending load are $10^5$ or less, fatigue failures initiated at the surfaces of the steel belts. In contrast, in the high cycle side in which the frequency of the repeated bending load is $10^7$ or more, fatigue failures initiated at the inclusions in the steel belts. As steel belts for CVT are used in higher cycle frequencies of repeated bending load, and it is therefore understood that it is very important to reduce the size and number of inclusions in order to ensure sufficient fatigue strength to withstand the traveling and bending.

As methods of measuring inclusions, there may be, for example the United States standards ASTM: E1245-89 (measuring method for inclusions in steel and other metals by automatic image analysis) and ASTM: E1122-92 (evaluation method for jk inclusions by automatic image analysis), and these method are similar to methods used in other countries. A method may also be mentioned in which the proportion of the number of inclusions on the standard lattice points provided in a visual field of a microphotograph or a video camera, which is used in Japan.

However, in the above methods, as a section exposed on a surface of a sample is measured, the actual size is typically larger than the result of the measurement. Therefore, in evaluation methods for inclusions in maraging steel for steel belts which concern large inclusions, the correlation between the evaluation result and fatigue strength is low, and there is therefore a problem in reliability. Recently, statistics extremes methods in which the maximum size of inclusions is estimated based on the size of one section of an inclusion has attracted attention (for example as in, Anti corrosion Engineering, Vol. 37, pages 768 to 773 (1988); Japanese Patent Application, First Publication, No. 2073/94; and Japanese Patent Application, First Publication, No. 170502/98). Generally, it is assumed that the distribution of inclusions in metallic material is similar to an exponential distribution. Furthermore, it is known that the extremes distribution seems to follow a double exponential distribution, and therefore the maximum size of inclusions can be estimated by using a statistics extremes method. In the following, the process for evaluating inclusions by a general statistics extremes method is shown.

(1) Extraction of Sample

A sample is cut along a face perpendicular to the direction of principal stress, and the sample surface is ultimately polished by using #2000 sandpaper, and is then finished by buffing to a specular surface.

(2) Image Processing of Inclusions

The sample surface is photographed by microphotography or by a video camera, and one visual field obtained thereby is defined as an standard inspecting area, and the inclusion with the maximum area is specified in the standard inspecting area. The square root ($\sqrt{(\text{area})}$) of the area of the inclusion with the maximum area is calculated, and such a procedure is repeated N times in such a way that the inspection portions (visual fields) do not overlap.

(3) Statistical Processing

As shown in FIG. 6, the square root ($\sqrt{(\text{area})}$) of the area is plotted on a statistics extremes sheet. Then, a straight line is applied to the plotted points, and the value of the X coordinate is estimated as being the maximum size of the inclusions when the line is extrapolated to the recurrent period T.

However, in the measurement method for inclusions using the statistics extremes method, the object for measurement is a section of an inclusion exposed on the surface of the sample, and the actual size of the inclusion is not directly measured, but is merely estimated. It is therefore difficult to precisely measure the size of the inclusion using such methods. As a result, in conventional measurement methods, a very high safety margin must be set for the material strength in consideration of the effects of the inclusions on fatigue strength.

In order to improve wear resistance and fatigue strength to withstand the traveling and bending of steel belts and the like, method have been adopted in recent years in which the effects of elements, such as carbon and nitrogen, contributing to the formation of inclusions, have decreased. In particular, high-purity maraging steel can be produced by the methods in which nitride inclusions, typified by TiN, and carbide inclusions, typified by TiC, are not formed, and therefore very few inclusions exist in the maraging steel. As a result, evaluation of inclusions according to the sampling based on the present statistics extremes method varies greatly since the proportion of fine inclusions is large, and therefore the accuracy in statistical processions is low and the reliability is insufficient; so that the selection accuracy for the product is therefore insufficient.

SUMMARY OF THE INVENTION

An object of the invention is to provide a process for producing maraging steel having large residual compressive stress without an additional process such as shot-peening.

Another object of the invention is to provide a process for producing maraging steel, in which nitriding can be performed in a short period.

Another object of the invention is to provide a process for producing maraging steel, in which sizes of inclusions can be directly evaluated, and variations therein due to the presence of fine inclusions are small, and therefore the reliability of the obtained maximum size of the inclusions is greatly improved, and selection accuracy can thereby be improved.

According to research by the inventors, as shown in FIG. 4, it is demonstrated that residual compressive stress tends to be low when the carbon content of the surface portion of maraging steel increases. The reason for this is believed to be that carburizing occurs, as well as nitriding, when carbon is included in the nitriding reaction gas, the carbon permeates into the surface portion of the maraging steel and forms compounds, especially carbonitride, and the carbonitride obstructs the solution and diffusion of nitrogen. As shown in FIG. 1B, which is data supporting the above, the concentrations of carbon and nitrogen in the maraging steel are approximately in inverse proportion. The nitrogen concentration decreases according to the increase in the carbon concentration, and therefore the residual compressive stress decreases, as shown in FIG. 1A. According to research by the inventors, as shown in FIG. 4, it was demonstrated that although the residual compressive stress decreases according to increase in the carbon concentration, it is present at large values of $-80$ kg/mm$^2$ or more when the carbon concentration is 2 weight % or less.

The present invention has made according to the above knowledge. The invention provides a process for producing maraging steel comprising aging a thin plate made from maraging steel, and nitriding the thin plate in a nitriding reaction gas including ammonia gas so as to restrict the carbon concentration in the thin plate after nitriding to 2 weight % or less.

DETAILED DESCRIPTION OF THE INVENTION

A. Material and Solution Treatment

Figure 1A:
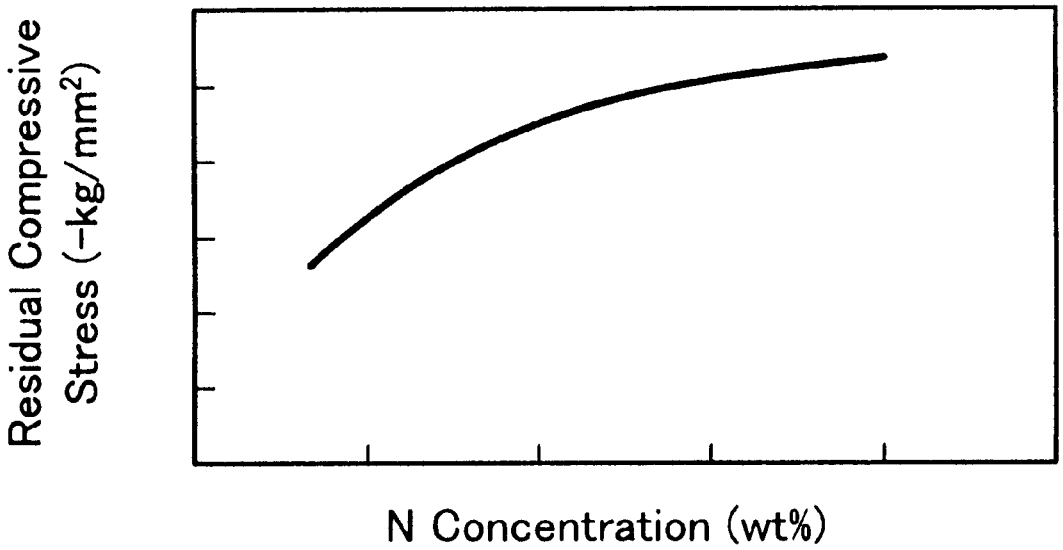
FIG. 1A is a diagram showing the relationship between nitrogen concentration and residual compressive stress.
Figure 1B:
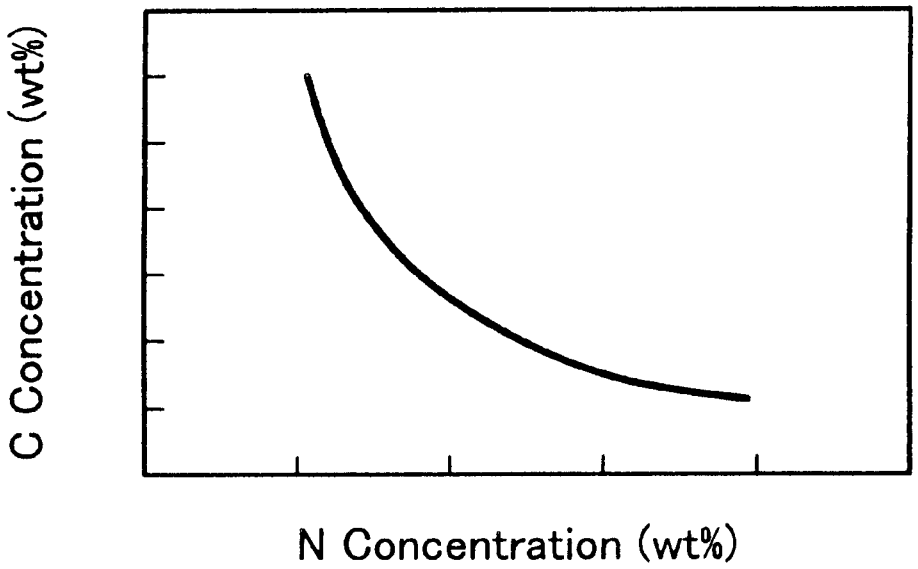
FIG. 1B is a diagram showing the relationship between nitrogen concentration and carbon concentration.

Materials for maraging steel are not limited. In particular, when the invention is applied to steel belts for CVT, it is preferable that it be a chemical composition comprising in weight %, 15 to 19% of Ni; 0.05 to 0.15% of Al; 3 to 5.5% of Mo; 0.4 to 1.5% of Ti; 8 to 15% of Co; 0.01% or less of C; 0.05% or less of Si; 0.05% or less of Mn; 0.008% or less of P; 0.004% or less of S; and the balance of Fe. When the invention is applied to steel belts for CVT, maraging steel is preferably formed into endless belts with thicknesses in the range of 0.1 to 0.3 mm. Solution treatment is performed for solid solution of the elements such as nickel, aluminum and titanium into austenite. The solution treatment is preferably performed in a vacuum furnace at a temperature in the range of 800 to 850° C. for a duration in the range of 30 minutes to 5 hours in order to avoid surface oxidation of the thin plate.

B. Aging Treatment

Aging treatment is performed for precipitation hardening of maraging steel by precipitating solute alloy elements in supersaturated martensite. The aging treatment may be performed by maintaining a thin plate of maraging steel, for example, in an inert gas at a temperature in the range of 460 to 500° C. for a duration in the range of 1 to 3 hours.

C. Fluoridation Processing

Fluoridation processing is preferably performed to form a flouride surface on the surface of maraging steel. Specifically, after performing an aging treatment to a thin plate made from maraging steel, a flouride layer is formed on the surface of the thin plate by heating and maintaining the thin plate in a fluoric reaction gas including fluorine gas, and the thin plate is then subjected to a nitriding processing in a nitriding reaction gas including ammonia gas.

By forming a fluoride layer on the surface, the formation of an oxide coating, which inhibits permeation of nitrogen in the nitriding processing, can be controlled. Furthermore, when nitrogen contacts the surface of the fluoride layer, this activates nitrogen and promotes permeation thereinto. Thus, in the invention, nitriding is promoted by the fluoride layer, and therefore large residual compressive stress can be provided in a short time. In the fluoridation processing, a fluoric reaction gas is used, in which fluorine gas is diluted by an inert gas. When $NF_3$ is used as a fluoric gas, fluoridation is performed by heating a fluoric reaction gas consisting of 1 to 10 volume % of $NF_3$ and the balance of nitrogen gas at a temperature in the range of 400 to 500° C., and by maintaining a thin plate in the fluoric reaction gas for a duration in the range of 10 to 60 minutes. As other fluoric reaction gases, in addition to $NF_3$, the gases $BF_3$, $CF_4$, HF, $SF_6$, $C_2F_6$, $WF_6$, $CHF_3$, $SiF_4$ may be used alone or in combination. Alternatively, $F_2$ can be used, which is produced by thermal decomposition of these fluoric reaction gases.

D. Nitriding Processing

In nitriding processing, the reaction represented by the following formula (1) occurs, and activated nitrogen [2N] is generated and permeates into the surface of the maraging steel. The permeated nitrogen infiltrates into the crystal lattice of the metallic structure, thereby providing strain in the crystal lattice and generating residual compressive stress.

$$2NH_3 \rightarrow [2N] + 3H_2 \quad (1)$$

Nitriding processing is performed by using nitriding reaction gas including ammonia gas. Nitriding reaction gas preferably consists of 5 to 20 volume % of ammonia gas and the balance of nitrogen gas, and preferably does not include carbon-containing molecules such as carbon dioxide, RX gas, and the like. If these gases are included, the concentration thereof is preferably no or very low (less than 10 volume %) in order to make the carbon concentration at the surface of the thin plate be 2 weight % or less.

E. Gas Processing Furnace

Figure 2:
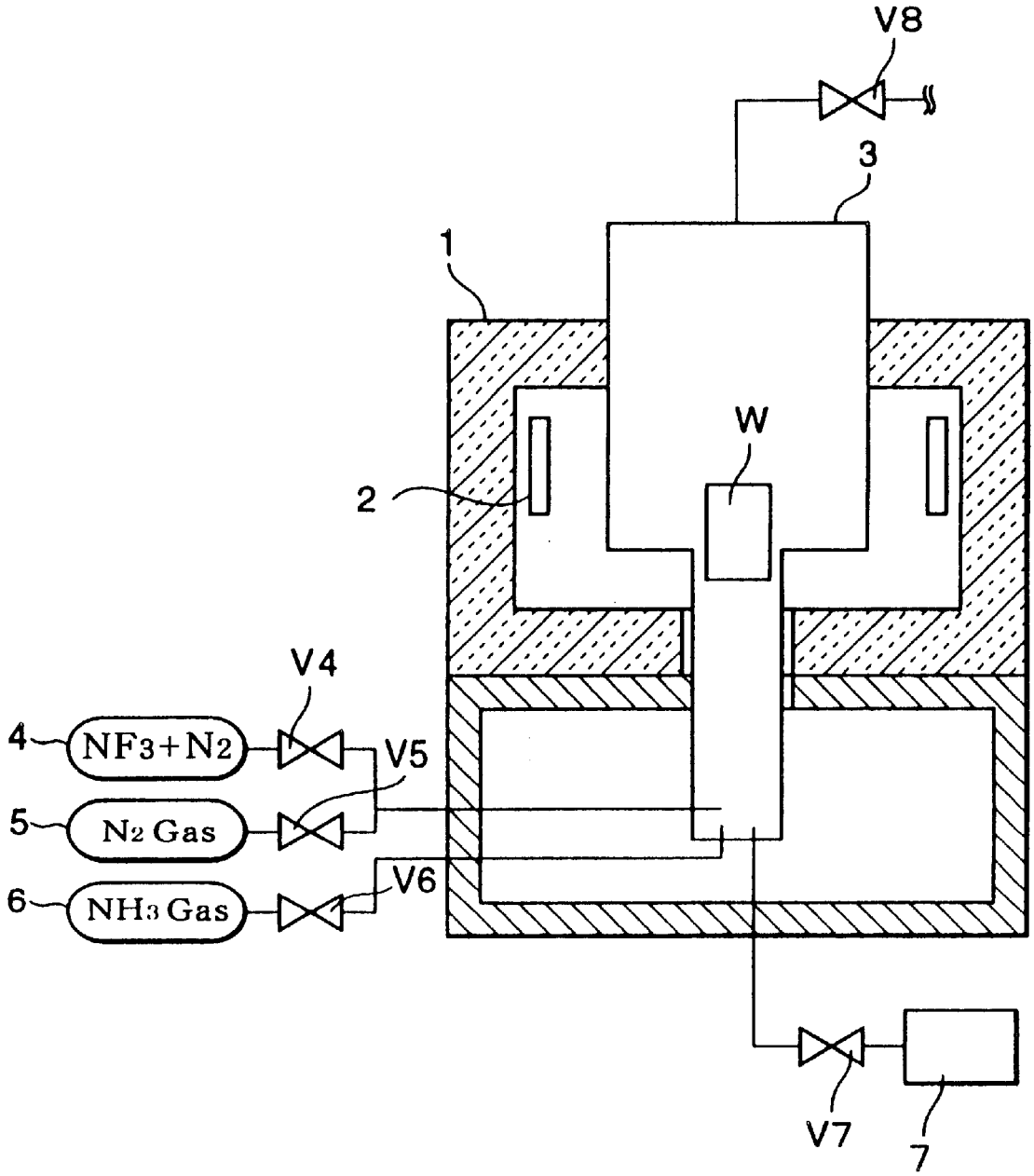
FIG. 2 is a schematic cross section of a gas treatment furnace of an embodiment according to the invention.

The above-mentioned aging treatment, fluoridation processing, and nitriding processing can be performed continuously by using a gas processing furnace as shown in FIG. 2. The gas processing furnace is approximately constructed by disposing a heater 2 and vacuum chamber 3 in a furnace body 1 which is provided with a heat insulating material. The vacuum chamber 3 is connected to a fluoric gas bomb 4, a nitrogen gas bomb 5, and an ammonia gas bomb 6 via valves V4 to V6, and is connected to a vacuum pump 7 via valve V7. The vacuum chamber 3 is connected to a valve V8 for discharging gases, so that the gases in the vacuum chamber 3 may be fed to a waste gas processing apparatus (not shown). It should be noted that a bomb containing a commercial nitriding reaction gas such as RX gas can be connected to the vacuum chamber 3 via a valve in addition to the above bombs. The processes in the gas processing furnace shown in FIG. 2 are explained hereinafter.

(1) Aging Treatment

In order to perform aging treatment on a thin plate made from maraging steel in the gas processing furnace as constructed above, first, a thin plate W which was subjected to solution treatment is contained in the vacuum chamber 3, and the valve V7 is opened and the vacuum pump 5 is driven, thereby evacuating the vacuum chamber 3. Then, the heater 2 is energized and the atmosphere in the chamber 3 is heated. The aging processing is completed by maintaining it at a temperature in the range of 460 to 500° C. for a duration in the range of 1 to 3 hours.

(2) Fluoridation Processing Next, the valve V4 is opened and a fluoric gas such as $NF_3$ gas is supplied into the vacuum chamber 3 from the fluoric gas bomb 4. The fluoric gas can be used alone, but normally is used by mixing it with an inert gas such as $N_2$ gas. In this case, the concentration of the fluoric gas is adjusted to be in the range of 1 to 10 volume %, and the energizing of the heater 2 is adjusted so that the temperature of the fluoric reaction gas is in the range of 400 to 500° C. The fluoridation processing is completed by maintaining this condition for a duration in the range of 10 to 60 minutes.

(2) Nitriding Processing

Next, the valve V4 is closed to stop the supply of the fluoric gas, and the valve V6 is opened to supply $NH_3$ gas into the vacuum chamber 3. The concentration of the nitriding reaction gas is adjusted to consist of 5 to 20 volume % of $NH_3$ gas and the balance of $N_2$ gas, and the energizing of the heater 2 is adjusted so that the temperature of the nitriding reaction gas is in the range of 450 to 500° C. The nitriding processing is completed by maintaining this condition for a duration in the range of 0.5 to 2 hours.

F. Evaluation of Inclusions

In the invention, it is preferable to calculate the maximum size of inclusions included in maraging steel by using a statistics extremes method, and to evaluate the inclusions in the maraging steel for selection based on the results of the calculation. In this case, a sample of maraging steel is dissolved in a solution, and only the inclusions remain in the solution, and the inclusions in the solution are then screened by a filter with predetermined mesh size so as to remove fine inclusions. The inclusions remaining on the filter are sampled, and the maximum size of the inclusions is calculated based on the statistics extremes method.

By applying the evaluation method for inclusions in maraging steel to the invention, rather than cross sections of the inclusions, the actual sizes of inclusion in maraging steel can be measured. Furthermore, larger numbers of inclusions are easily sampled, so that reliability in determinations of the sizes and numbers of inclusions can be improved, and a large number of inclusions can be easily and quickly obtained. In addition, the sampling is performed on inclusions having a predetermined size or greater, so that disturbance in plotted points on a statistics extremes sheet due to fine inclusions can be prevented. Therefore, reliability of the estimated value of the maximum size of inclusions obtained from the plots can be improved, and the accuracy of selection of maraging steel is improved.

The filter preferably has a mesh size at least 0.5 times the predetermined value for the standard tolerance for the size of inclusions. According to research by the inventors, it was confirmed that small inclusions causing disturbance of the plotted points are sufficiently removed, and that double exponential distributions or plots similar thereto could be obtained on a statistics extremes sheet by using such a filter. As solutions for dissolving samples, Br—MeOH solution and nitric acid can be used. The Br—MeOH solution is a mixed solution of bromine guaranteed reagent (at a concentration of 99%) and methyl alcohol extra pure reagent (at a concentration of 99%).

EXAMPLE 1

The invention will be explained further in detail with reference to specific examples hereinafter.

Material consisting of by weight, 17.9% of Ni, 0.07% of Al, 4.78% of Mo, 0.48% of Ti, 7.76% of Co, 0.005% of C, 0.0003% of S, 0.008% of Mn, 0.004% of P, and the balance of iron was formed into a plate with a thickness of 0.2 mm, a width of 9.0 mm, and a length of 300 mm. The plate was then inserted into a vacuum furnace, and solution treatment was performed therein by heating the plate to a temperature of 820° C. for 120 minutes, and then it was cooled Then, the plate was inserted into the vacuum chamber 3 of the gas processing furnace shown in FIG. 2, and aging treatment, fluoridation processing and nitriding processing were performed in the condition shown in Table 1. The concentration of $NH_3$ in Example 1 was 10 volume %. As comparative examples, aging treatment and nitriding processing were performed under the conditions shown in Table 1. As is clearly shown in Table 1, the duration for the nitriding processing in Example 1 is half that of the comparative examples.

TABLE 1

| | Aging | | Fluoridation | | Nitriding | | |
|---|---|---|---|---|---|---|---|
| | Temp. (° C.) | Time (min) | Temp. (° C.) | Time (min) | Temp. (° C.) | Time (min) | Gas |
| Example 1 | 480 | 120 | 460 | 40 | 460 | 30 | $NH_3$ + $N_2$ |
| Comparative Example 1 | 480 | 120 | None | | 500 | 60 | $NH_3$ + $N_2$ + RX |
| Comparative Example 2 | 480 | 120 | None | | 500 | 60 | $NH_3$ + $N_2$ + RX |
| Comparative Example 3 | 480 | 120 | None | | 500 | 60 | $NH_3$ + $N_2$ + RX |

Figure 3:
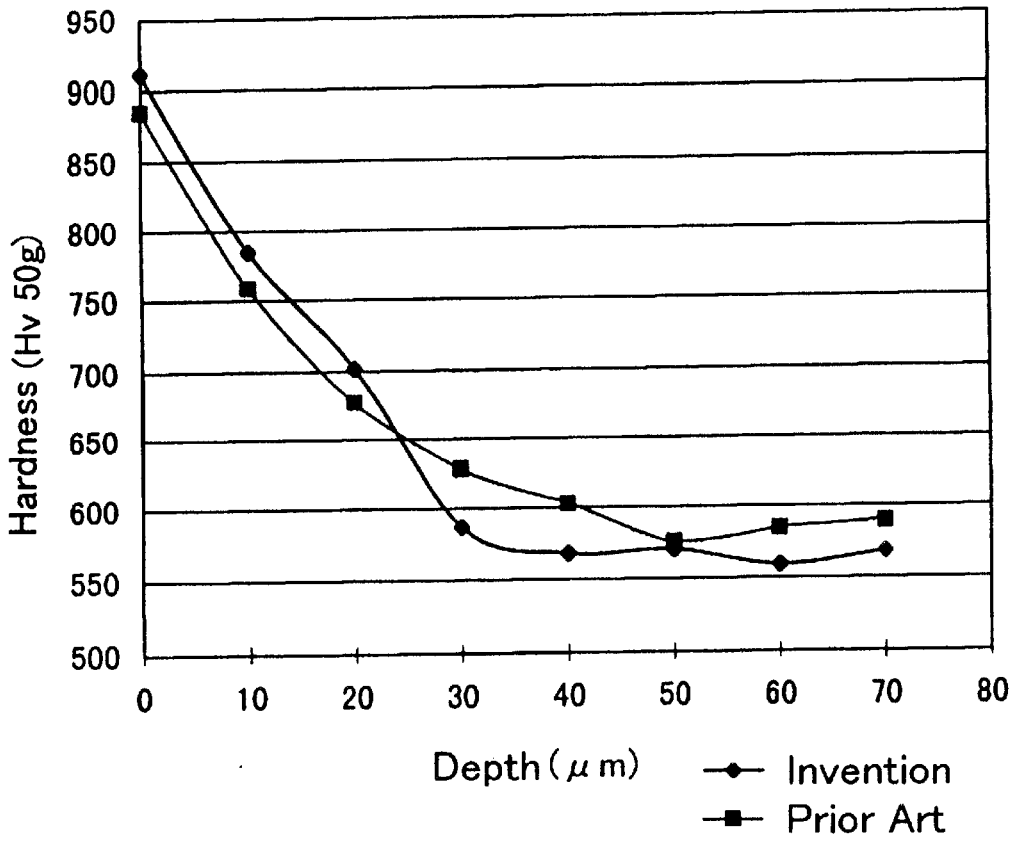
FIG. 3 is a diagram showing the relationship between the depth from a surface of a thin plate and the hardness thereof in a first example.

Then, the thin plates in Example 1 and Comparative Example 2 were cut along the thickness direction, and the hardness of the cross section of the thin plate was measured by using a micro Vickers hardness meter (a load of 90 g) versus various depths from the surface. The results are shown in FIG. 3. As shown in FIG. 3, the hardnesses at the surface and the inside of the thin plates in the Example 1 and Comparative Example 2 are almost the same. However, the hardness in Example 1 decreases drastically from the depth of 20 $\mu$m, which indicates that the depth of the hardened layer by the nitriding processing is shallow and toughness is large.

Figure 4:
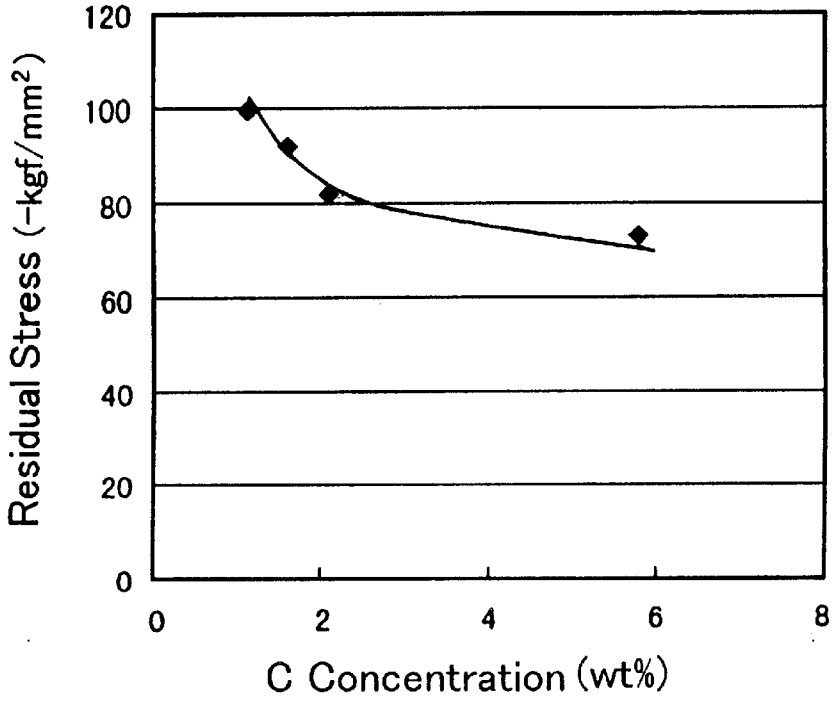
FIG. 4 is a diagram showing the relationship between the carbon concentration of the thin plate and the residual compressive stress in the first example.
Figure 5:
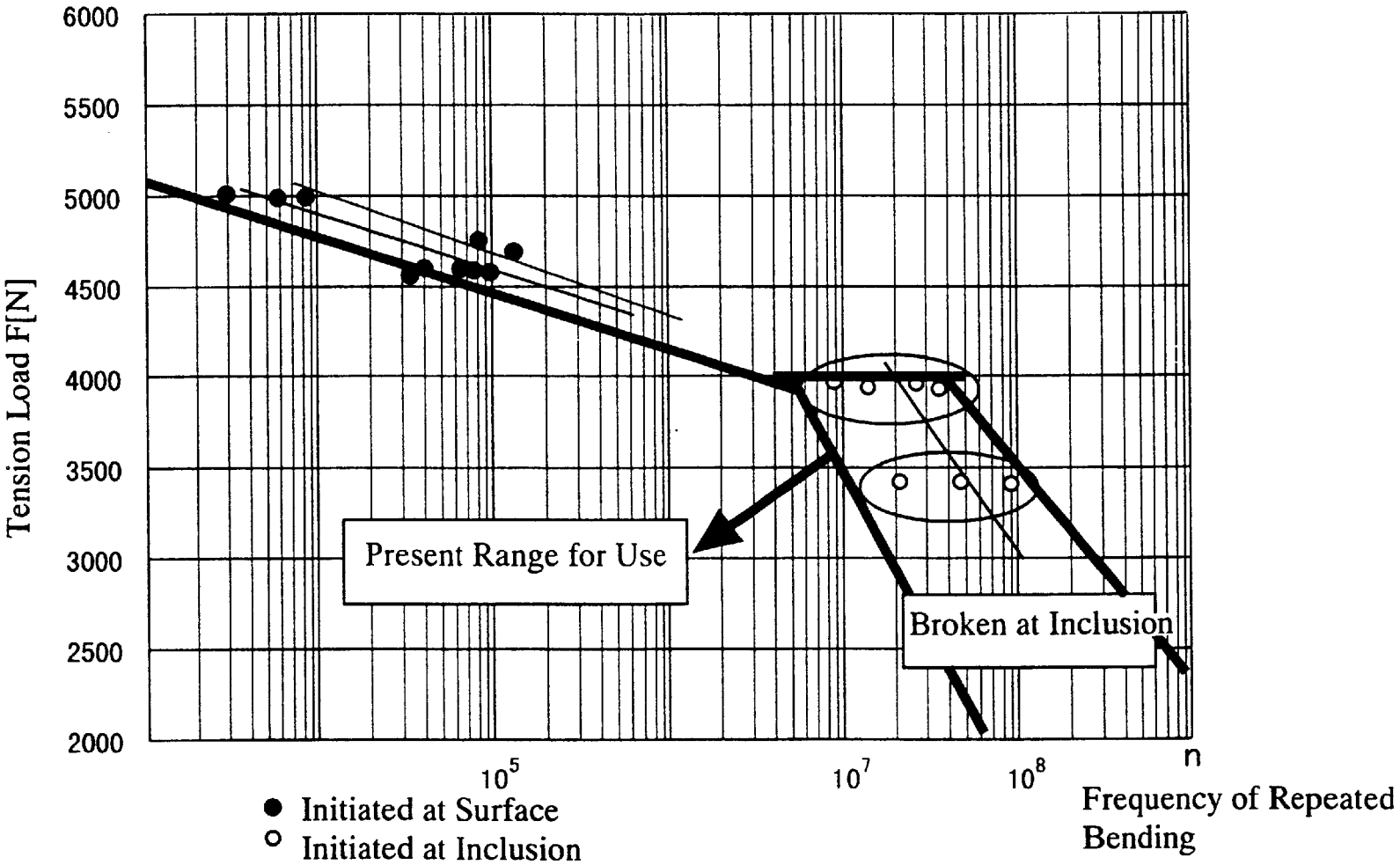
FIG. 5 is a diagram showing the relationship between the frequency of repeated bending and the tension load in a rotating and bending fatigue test.
Figure 6:
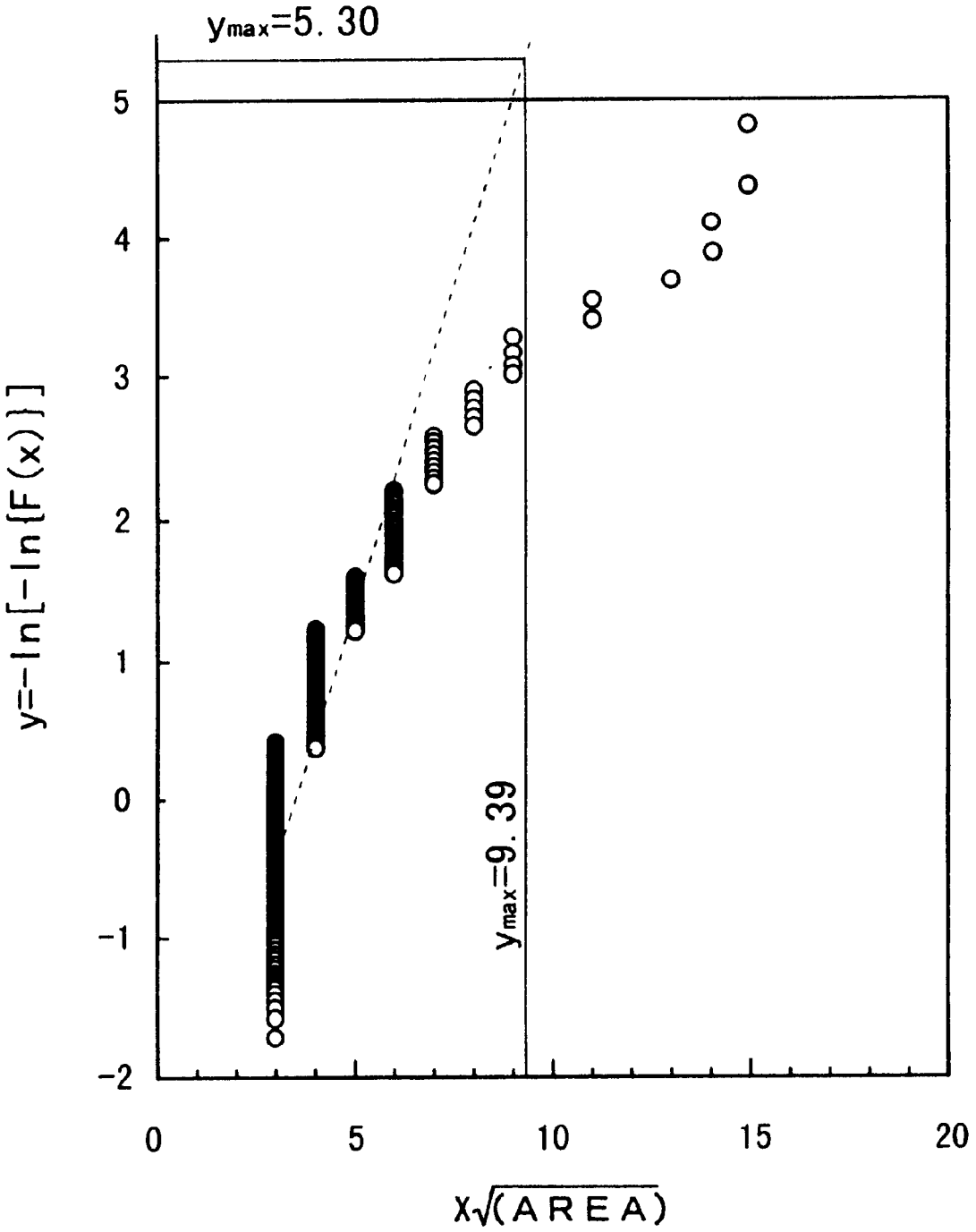
FIG. 6 is a diagram showing the distribution of sizes of inclusions in a conventional statistics extremes method.

The compositions of the nitriding reaction gases used in Example 1 and Comparative Examples 1 to 3 are shown in Table 2. The residual compressive stress obtained by X-ray diffraction analysis of the surface of the thin plate, and the carbon concentration and the nitrogen concentration at the point at a depth of 0.5 $\mu$m from the surface in each thin plate are shown in Table 2. The relationship between the carbon concentration and the nitrogen concentration are shown in FIG. 4. As is clearly shown in Table 2, at the surface of the thin plate in Example 1, the carbon concentration is low and the nitrogen concentration is high, and the residual compressive stress is large. In contrast, at the surface of the thin plate in Comparative Examples 1 to 3, the carbon concentration is high and the nitrogen concentration is small, and the residual compressive stress is low, and these values vary extremely. Thus, in Example 1, large residual compressive stress can be obtained since the nitriding reaction gas does not contain carbon. As is clearly shown in FIG. 4, it was confirmed that large residual compressive stress was obtained when the carbon concentration was 2 weight % or less. It was confirmed that the desired residual compressive stress could not be obtained when the concentration of the RX gas is 10 volume % or more in the nitriding processing using the RX gas as in the conventional method.

TABLE 2

| | Types and Flow Amount (vol. %) of Fluoric Gas | | | Residual Compressive Stress | Composition | |
|---|---|---|---|---|---|---|
| | $NH_3$ | RX | $N_2$ | (kgf/mm$^2$) | C | N |
| Example 1 | 10 | 0 | 90 | −99.6 | 1.1 | 3.9 |
| Comparative Example 1 | 60 | 40 | 0 | −92.1 | 1.6 | 1.2 |
| Comparative Example 2 | 60 | 40 | 0 | −72.6 | 5.8 | 1.0 |
| Comparative Example 3 | 90 | 10 | 0 | −81.5 | 2.1 | 1.4 |

As explained above, in Example 1, the thin plate made from maraging steel was subjected to nitriding processing after fluoridation, so that the nitriding is promoted and large residual compressive stress can be obtained since in short time.

EXAMPLE 2

A. Sampling

Samples were obtained by cutting the thin plate produced in Example 1 and were dipped into a container filled with Br—MeOH solution. The solution was then agitated by ultrasonic vibration and the sample was dissolved. Plural such solutions were prepared, and these solutions were screened using filters having various mesh sizes so as to sample inclusions. The filters were made from polycarbonate fiber, and the mesh size were 0.2 $\mu$m, 3.0 $\mu$m, and 10.0 $\mu$m. Next, the inclusions were uniformly dispersed for sampling on the surface of the filter.

B. Analysis of Inclusions

The total area S, where inclusions dispersed on the filter existed, was obtained by using an image analysis device, and the inspection standard area s was determined so that the recurrent period T (S/s) was 200. Then, by using a FE-SEM (field emission scanning electron microscope) and the image analysis device, the inspection standard area was defined in one visual field of the video camera of the image analysis device, and the inclusion with the maximum size in the visual field was specified. The square root ($\sqrt{(\text{area})}$) of the inclusion was calculated, and such a measurement was repeated N times in such a way that the inspection portions (visual fields) did not overlap.

C. Plotting on Statistics Extremes Sheet

Figure 7:
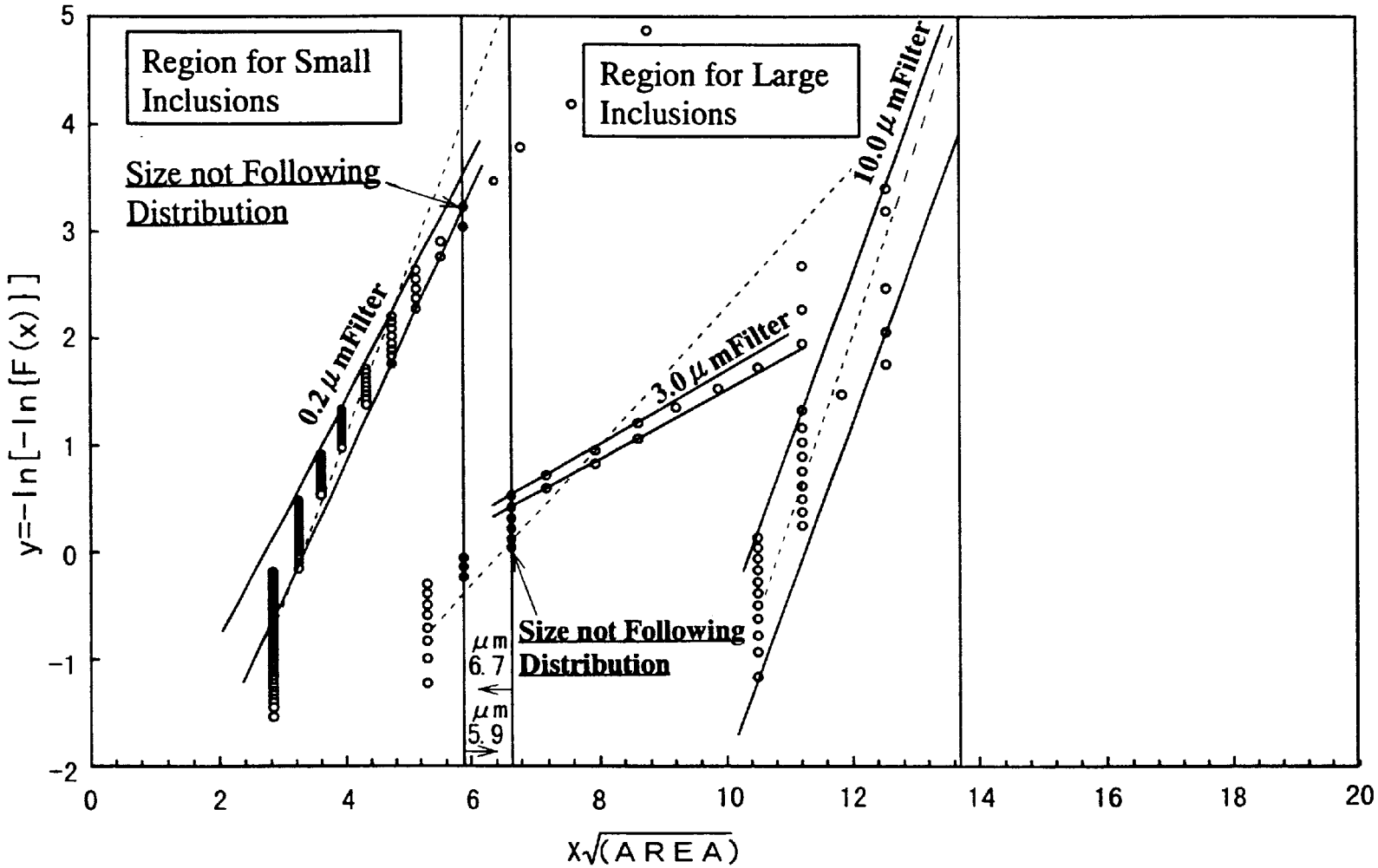
FIG. 7 is a diagram showing the distribution of sizes of inclusions in each filter in a statistics extremes method according to Example 1.

FIG. 7 is a diagram in which the sizes (square root of the areas) are plotted for each filter along the horizontal axis on a statistics extremes sheet. As shown in FIG. 7, two straight lines can be applied to the plotted points for each filter along the maximum values and the minimum values of the cumulative distribution (vertical axis) of each particle size. The plotted points existing between the two straight lines follow the double exponential distribution. As is clearly shown in FIG. 7, approximately all the plotted points exist between the two lines when the mesh size of the filter is 10 $\mu$m. However, when the mesh size of the filter is 0.2 $\mu$m or 3.0 $\mu$m, it will be understood that some plotted points greatly deviate from the region between the two straight lines according to the sizes of the inclusions, and that this does not follow the double exponential distribution. Specifically, when the mesh size of the filter is 0.2 $\mu$m, the plotted points for inclusions with the sizes of 5.9 $\mu$m or more do not follow the double exponential distribution. When the mesh size of the filter is 3.0 μm, the plotted points for inclusions with the sizes of 6.7 μm or less do not follow the double exponential distribution. Therefore, it will be understood that for evaluation for inclusions in the sample, only the inclusions which follow the double exponential distribution are screened and remain when the mesh size is 6.7 μm or more.

Figure 8:
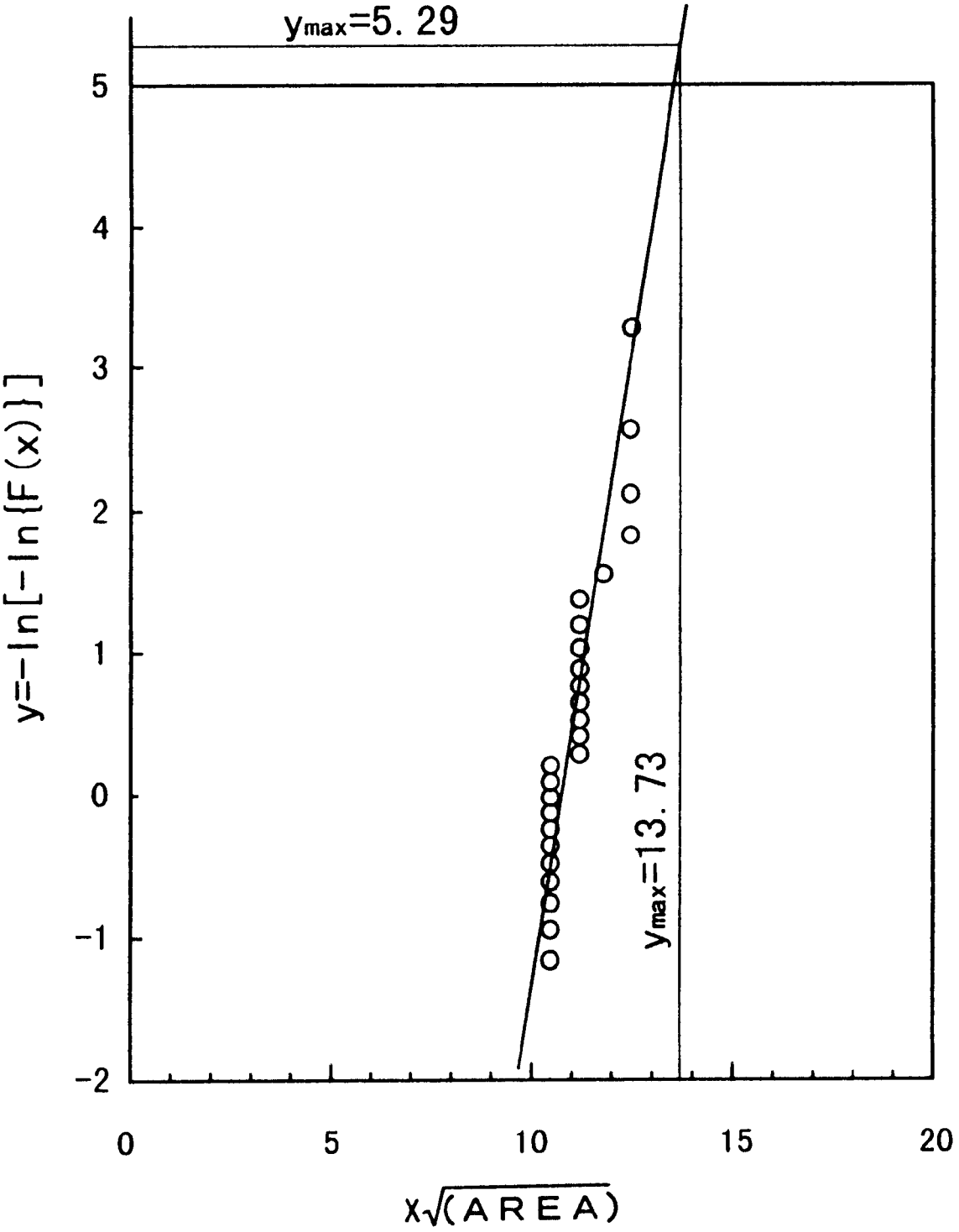
FIG. 8 is a diagram showing the distribution of sizes of inclusions which are screened by a filter having a mesh size of 10 $\mu$m in a statistics extremes method according to Example 2.

FIG. 8 shows a diagram in which the sizes of the inclusions screened by the filter with a mesh size of 10.0 μm are plotted on another statistics extremes sheet. In FIG. 8, the straight line applied to the plotted points is shown. The value indicated along the horizontal axis is the normalization variable (y), and the recursion period T and y satisfy the following formula when the value T is large ($T \geqq 18$).

$$Y = \ln T \quad (2)$$

As the recursion period T is 200 in the Example 2, when the value of T is applied to the formula (2), the value of y is 5.29. This value is the maximum value of the normalization variable (y) in FIG. 8. The value of the X coordinate is 13.73 (μm) when the line is extrapolated to the value of y (=5.29), and the value is estimated as a maximum size of the inclusions. The maximum size is approximately two times the minimum value (6.7 μm) of the mesh size of the filter, which is obtained from FIG. 7. Therefore, it will be understood that the mesh size of the filter may be considered to be at least 0.5 times the maximum size of the inclusions.

In actual quality control for steel belts, etc., the maximum size of inclusions is not obtained without sampling of inclusions by using filters and evaluations such as the above. That is, the mesh size of the filter cannot be selected based on the maximum size (estimated value) of inclusions. Therefore, the value established as a standard tolerance of the size of inclusions can be based instead of the maximum value of inclusions. For example, when the standard tolerance is 10 μm, inclusions will be screened using a filter with a mesh size of 5 μm or more.

As explained above, in Example 2, it is demonstrated that fine inclusions or those of small sizes do not follow the double exponential distribution, and therefore it is confirmed that the estimated value of the maximum size of inclusions by screening the inclusions by using filters is reliable. In particular, by using filters with mesh sizes of at least 0.5 times the standard tolerance of the size of the inclusions, a large portion or nearly all of the inclusions can be followed the double exponential distribution. Therefore, the reliability of the evaluation for inclusions can be greatly improved, and accuracy for selection of maraging steel can be improved.

As explained above, in Example 2, a sample of maraging steel is dissolved in a solution so that only inclusions remain therein, the inclusions remaining in the solution are screened by a filter to remove small inclusions, and therefore the actual sizes of inclusions can be measured. In addition, the sampling is performed on the inclusions having a predetermined size or larger, so that disturbance in plotted points on a statistics extremes sheet due to fine inclusions can be prevented. Therefore, the reliability of the evaluation for inclusions can be greatly improved, and accuracy for selection of maraging steel can be improved.

What is claimed is:

1. A method for producing maraging steel comprising:

performing solution treatment in a vacuum furnace to a thin plate made from maraging steel;

aging the thin plate in an inert gas;

performing fluoridation processing by heating and maintaining the thin plate in a, fluoric reacting gas including fluorine so as to form a fluoride layer on a surface of the thin plate; and then nitriding the thin plate in a nitriding reaction gas including ammonia gas so as to restrict the carbon concentration of the thin plate after the nitriding at 2 weight % or less;

wherein the nitriding reaction gas includes no or very low amounts of carbon.

2. A method for producing maraging steel according to claim 1, wherein the carbon concentration of the nitriding reaction gas is 10 volume % or less.

3. A method for producing maraging steel according to claim 1, wherein the maraging steel comprises in weight %, 15 to 19% of Ni; 0.05 to 0.15% of Al; 3 to 5.5% of Mo; 0.4 to 1.5% of Ti; 8 to 15% of Co; 0.01% or less of C; 0.05% or less of Si; 0.05% or less of Mn; 0.008% or less of P; 0.004% or less of S; and the balance of Fe.

4. A method for producing maraging steel according to claim 1, wherein the maraging steel is a endless belt with a thickness in the range of 0.1 to 0.3 mm.

5. A method for producing maraging steel according to claim 1, wherein the fluoridation processing is performed in a fluoric reaction gas consisting of 1 to 10 volume % of $NF_3$ and the balance of nitrogen gas.

6. A method for producing maraging steel according to claim 5, wherein the fluoridation processing is performed by heating the fluoric reaction gas at a temperature in the range of 400 to 500° C., and by maintaining the thin plate in the fluoric reaction gas for a duration in the range of 10 to 60 minutes.

7. A method for producing maraging steel according to claim 1, wherein the nitriding is performed in a nitriding reaction gas consisting of 5 to 20 volume % of ammonia gas and the balance of nitrogen gas.

8. A method for producing maraging steel comprising:

aging a thin plate made from maraging steel;

performing fluoridation processing by heating and maintaining the thin plate in a fluoric reacting gas including fluorine so as to form a fluoride layer on a surface of the thin plate; and then, nitriding the thin plate in a nitriding reaction gas including ammonia gas so as to restrict the carbon concentration of the thin plate after the nitriding at 2 weight % or less;

calculating the maximum size of inclusions included in the maraging steel by using a statistics extremes method;

evaluating the inclusions in the maraging steel to select the maraging steel;

wherein a sample of maraging steel is dissolved in a solution;

only the inclusions remain in the solution;

the inclusions in the solution are screened by a filter so as to remove smaller inclusions;

the inclusion remaining on the filter are sampled; and the maximum size of the inclusions is calculated based on the statistics extremes method.

9. A method for producing maraging steel according to claim 8, wherein the filter has a mesh size at least 0.5 times the value for the standard tolerance of the size of the inclusions.

* * * * *